US011598155B2

(12) United States Patent
Hassani et al.

(10) Patent No.: US 11,598,155 B2
(45) Date of Patent: Mar. 7, 2023

(54) BIT CONDITION MONITORING SYSTEM AND METHOD

(71) Applicant: THE ROYAL INSTITUTION FOR THE ADVANCEMENT OF LEARNING/MCGILL UNIVERSITY, Montreal (CA)

(72) Inventors: Faramarz (Ferri) P. Hassani, Beaconsfield (CA); Hamed Rafezi, Montreal (CA)

(73) Assignee: THE ROYAL INSTITUTION FOR THE ADVANCEMENT OF LEARNING/MCGILL UNIVERSITY, Montreal (CA)

( * ) Notice: Subject to any disclaimer, the term of this patent is extended or adjusted under 35 U.S.C. 154(b) by 0 days.

(21) Appl. No.: 16/652,525

(22) PCT Filed: Oct. 2, 2018

(86) PCT No.: PCT/CA2018/051236
§ 371 (c)(1),
(2) Date: Mar. 31, 2020

(87) PCT Pub. No.: WO2019/068179
PCT Pub. Date: Apr. 11, 2019

(65) Prior Publication Data

US 2020/0284099 A1 Sep. 10, 2020

Related U.S. Application Data

(60) Provisional application No. 62/566,786, filed on Oct. 2, 2017.

(51) Int. Cl.
*E21B 12/02* (2006.01)
*E21B 44/00* (2006.01)

(52) U.S. Cl.
CPC ..... *E21B 12/02* (2013.01); *E21B 44/00* (2013.01)

(58) Field of Classification Search
CPC ..... E21B 12/02; E21B 44/00
See application file for complete search history.

(56) References Cited

U.S. PATENT DOCUMENTS

| | | | |
|---|---|---|---|
| 4,644,335 | A | 2/1987 | Wen |
| 4,928,521 | A | 5/1990 | Jardine |
| 6,681,633 | B2 | 1/2004 | Schultz et al. |

FOREIGN PATENT DOCUMENTS

| | | | |
|---|---|---|---|
| CN | 2595978 | Y | 12/2003 |
| CN | 1512032 | A | 7/2004 |

(Continued)

OTHER PUBLICATIONS

Li Shusheng, Machine translation of "Real-time monitoring method and system for cone bit wear situation" (Year: 2004).*

(Continued)

*Primary Examiner* — Kristyn A Hall
(74) *Attorney, Agent, or Firm* — Norton Rose Fulbright Canada LLP

(57) ABSTRACT

A system for monitoring a bit condition in a drilling operation comprises a processor unit and a non-transitory computer-readable memory communicatively coupled to the processing unit and comprising computer-readable program instructions executable by the processing unit for: obtaining signals representative of at least vibrations of a drilling mast having at least one bit during a drilling operation; interpreting the signals into vibration values; continuously monitoring the vibration values in real time; and assessing and outputting a condition of the bit as a function of the continuous monitoring of the vibration values.

18 Claims, 6 Drawing Sheets

(56) References Cited

FOREIGN PATENT DOCUMENTS

| | | |
|---|---|---|
| EP | 0196567 A2 | 10/1986 |
| WO | 0238916 A2 | 5/2002 |

OTHER PUBLICATIONS

Rafezi, et al., Drill Bit Wear Monitoring Based on Vibration Signal Analysis. Proceedings of the 30th International Conference on Condition Monitoring and Diagnostic Engineering Management (COMADEM) 2017, Jul. 13, 2017, pp. 303-308.

El-Wardany et al., Tool Condition Monitoring in Drilling Using Vibration Signature Analysis International Journal of Machine Tools and Manufacture, Jun. 18, 1996, vol. 36(6), pp. 687-711.

* cited by examiner

BIT CONDITION MONITORING SYSTEM AND METHOD

CROSS-REFERENCE TO RELATED APPLICATION

The present application claims the priority of U.S. Provisional Patent Application No. 62/566,786, filed on Oct. 2, 2017, and incorporated herein by reference.

TECHNICAL FIELD

The present application relates to drilling bits used in mining operations, and more particularly to a method and system for monitoring a bit condition.

BACKGROUND OF THE ART

For the majority of open-pit mining operations, the first stage of comminution involves the drilling and blasting of an intact rock mass. In order to maximize the efficiency and placement of explosive energy, vertical or inclined blast holes are created using large hydraulically or electrically-controlled drill rigs. The applied weight and rotational forces produced by these machines are then transferred to a drill bit which advances through the rock mass by a process of induced compressive and shearing failure mechanisms. In addition to having high initial capital costs, factors such as maintenance, manpower, and energy requirements act to increase the total cost of operating this machinery. Also, since drilling and blasting represents the start of the mining production process, mine operators require these machines to be highly productive and constantly available.

Wear happens as a result of bit-rock interaction and major failure modes of tricone bits could be defined in three categories, namely gradual wear, teeth breakage and bearing failure. Gradual wear is a type of wear which can happen on the teeth, cones as well as shirttail structure. Teeth breakage may occur as a result of repeated impacts and fatigue in the harsh drilling environment. Teeth breakage is one of the major problems in drilling with a drill bit known as tricone. Bearing failure results from the effects of wear on the bearing elements as well as the cones and cutting structure will result in progressive wear in the cones rotary structure and bearing failure eventually.

To avoid downtime, some approaches have been developed to evaluate bit wear. One such approach is a performance-based method. The current state of bit wear is determined by monitoring penetration rate and torque. Assuming a constant rock type, and therefore a uniform rock strength, and constant operating conditions, the penetration rate will decrease over time as bit wear increases. Once the penetration rate has fallen below a pre-determined value, the bit should be replaced. This procedure is applicable for gradual tooth wear. For cone bearing failures, the torque could be a criterion. Any observation of a rapid rise in torque while under constant operating conditions is a sign of bearing failure. A bearing failure requires immediate bit replacement.

Unfortunately, the requirement of constant operating conditions and rock type is not the case in the open pit mining environment. Typically, several rock layers are encountered during the drilling of a single hole. Some layers may even be composed of entirely broken and non-homogenous rock material. At some particularly dynamic mine sites, rock layers can be encountered in differing orders from one hole to the next within the same drill pattern. This dynamic, and often unknown, in-situ geology makes it difficult to determine if penetration rate is decreasing or torque is spiking because of bit wear/failure or because a new rock layer is being encountered. This problem results in an essential limitation on performance-based drill bit wear monitoring and is a motivation to explore new approaches and models for bit wear monitoring.

SUMMARY

It is therefore an aim of the present disclosure to provide a bit condition monitoring system that addresses issues related to the prior art.

It is a further aim of the present disclosure to provide a method for monitoring bit condition that addresses issues related to the prior art.

In accordance with a first embodiment, there is provided a system for monitoring a bit condition in a drilling operation, the system comprising: a processor unit; and a non-transitory computer-readable memory communicatively coupled to the processing unit and comprising computer-readable program instructions executable by the processing unit for: obtaining signals representative of at least vibrations of a drilling mast having at least one bit during a drilling operation; interpreting the signals into vibration values; continuously monitoring the vibration values in real time; and assessing and outputting a condition of the bit as a function of the continuous monitoring of the vibration values.

Further in accordance with the first embodiment, continuously monitoring the vibration values includes for instance monitoring a lower frequency range of the vibration values to determine a geology index, and monitoring a higher frequency range of the vibration values to identify a fault frequency relative to a threshold based on the geology index.

Still further in accordance with the first embodiment, monitoring the lower frequency range and the higher frequency range includes for instance performing a wavelet decomposition of the vibration signals.

Still further in accordance with the first embodiment, assessing the bit condition includes for instance classifying the bit condition as a function of the fault frequency and of the geology index.

Still further in accordance with the first embodiment, classifying the bit condition includes for instance outputting a class for the bit condition.

Still further in accordance with the first embodiment, outputting a class includes for instance outputting the class from among a group of classes including: Class 1, new bit; Class 2, slight wear on teeth of cone edges; Class 3, at least one bearing with looseness, progressive teeth wear and/or missing teeth; Class 4, deterioration stage with loose bearing and accelerated bearing and/or teeth wear; and Class 5, excessive bearing looseness and bit change required to avoid bearing failure.

Still further in accordance with the first embodiment, the computer-readable program instructions executable are for instance for monitoring a current of a motor of the drilling mast while monitoring the vibration values, and wherein assessing the bit condition includes confirming the bit condition using the current of the motor.

Still further in accordance with the first embodiment, assessing and outputting a condition of the bit includes for instance commanding a stop of drilling.

Still further in accordance with the first embodiment, interpreting the signals into vibration values includes for instance converting the vibrations values from a time domain to a frequency domain.

In accordance with a second embodiment, there is provided an automated drilling rig comprising: at least one drilling mast having at least one drilling bit, the drilling mast operated in a drilling process; sensors on the drilling mast to monitor vibrations of the at least one drilling mast; an automated control system for operating the at least one drilling mast in the drilling process; and the system as described above to monitor the bit condition of the at least one drilling bit.

Still further in accordance with the second embodiment, the at least one drilling bit is for instance a tricone bit.

Still further in accordance with the second embodiment, the sensors include for instance accelerometers.

In accordance with a third embodiment of the present disclosure, there is provided a system for monitoring a bit condition in a drilling operation, comprising: sensors adapted to be positioned on or relative to a drilling mast having at least one bit to produce signals representative of at least vibrations during a drilling operation; a signal processing unit for interpreting the signals into vibration values; and a condition monitoring module for monitoring the vibration values in real time and assess and output a condition of the bit.

Further in accordance with the third embodiment, the condition monitoring module monitors for instance the vibration values by: monitoring a lower frequency range of the vibration values to determine a geology index, and monitoring a higher frequency range of the vibration values to identify a fault frequency relative to a threshold based on the geology index.

Still further in accordance with the third embodiment, the condition monitoring module monitors for instance the lower frequency range and the higher frequency range by performing a wavelet decomposition of the vibration signals.

Still further in accordance with the third embodiment, the condition monitoring module assesses for instance the bit condition by classifying the bit condition as a function of the fault frequency and of the geology index.

Still further in accordance with the third embodiment, the condition monitoring module classifies for instance the bit condition by outputting a class for the bit condition.

Still further in accordance with the third embodiment, the condition monitoring module outputs for instance a class from among a group of classes including: Class 1, new bit; Class 2, slight wear on teeth of cone edges; Class 3, at least one bearing with looseness, progressive teeth wear and/or missing teeth; Class 4, deterioration stage with loose bearing and accelerated bearing and/or teeth wear; and Class 5, excessive bearing looseness and bit change required to avoid bearing failure.

Still further in accordance with the third embodiment, the condition monitoring module monitors for instance a current of a motor of the drilling mast while monitoring the vibration values, and confirms the bit condition using the current of the motor.

Still further in accordance with the third embodiment, the condition monitoring module commands for instance a stop of drilling as a function of the bit condition.

Still further in accordance with the third embodiment, the signal processing unit interprets for instance the signals into vibration values by converting the vibrations values from a time domain to a frequency domain.

DETAILED DESCRIPTION

Figure 1:
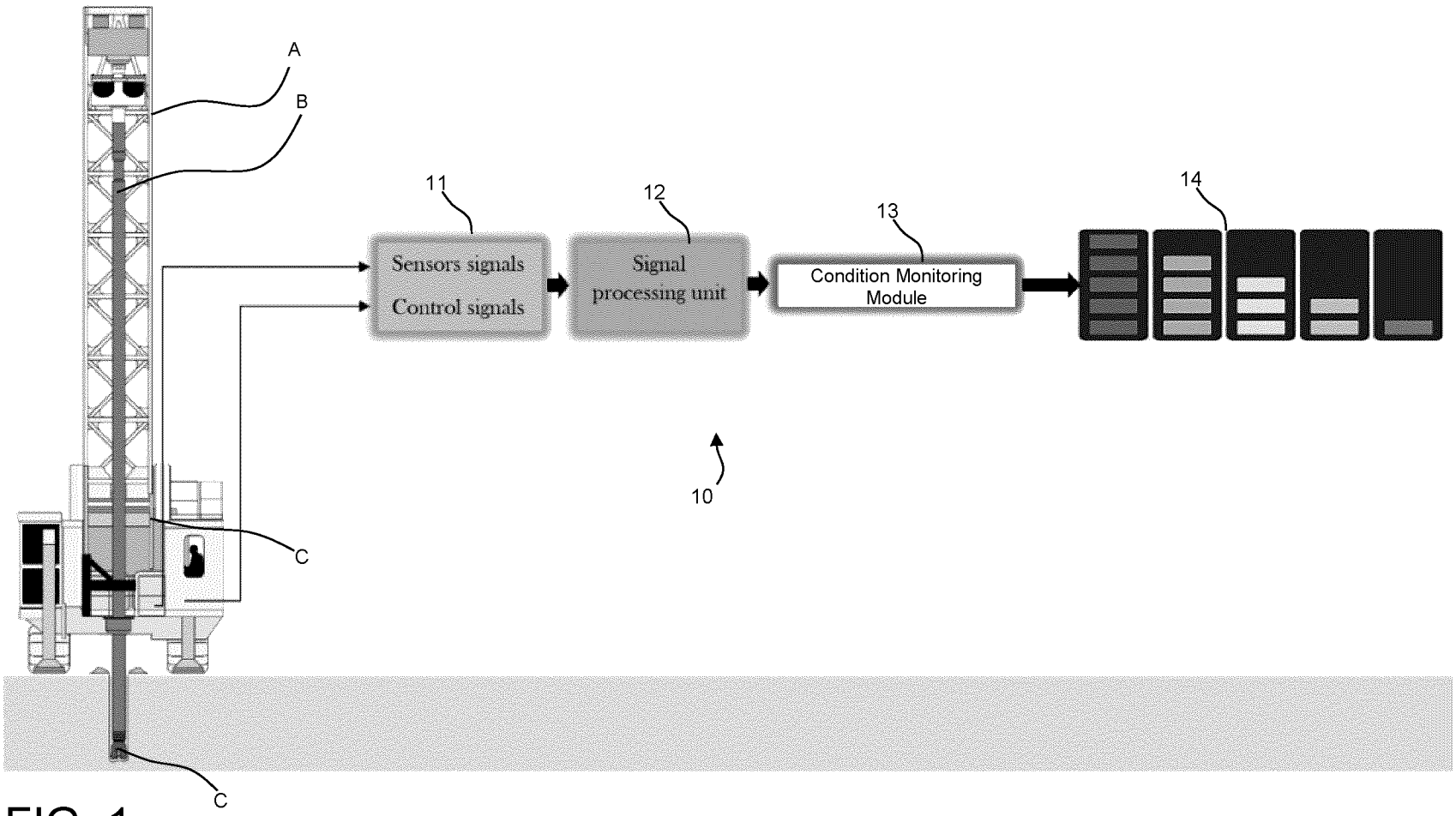
FIG. 1 is a schematic view of a bit condition monitoring system of the present disclosure.

According to the present disclosure, there is provided a method and system for bit wear condition monitoring. Referring to FIG. 1, there is illustrated a drilling rig having a drill mast A supporting a drill pipe B. Drill bit(s) C is at the leading end of the drill pipe B, as is conventionally known. In accordance with an embodiment, the drill bit C is a tricone bit, although other types of drill bits may be used in accordance with the present disclosure. In another embodiment, there is a single tricone bit C per drill pipe B. In another embodiment, the drilling rig is an automated drill rig, as the drilling is performed by an automated control system. A bit condition monitoring system 10 described herein may be integrated in the drilling rig, for instance as part of the control system of the drilling rig. As such, the bit condition monitoring system 10 may assist in the operation of any automated drilling operation.

The bit condition monitoring system in accordance with the present disclosure is generally shown at 10 in FIG. 1. The system 10 may be provided in or on the drilling rig (e.g., in the cabin), or at a remote location. According to an embodiment, various sensors 11 are provided on the drilling rig, at strategic locations, and may or may not be part of the system 10. The sensors 11 may be of any appropriate type, to measure parameters such as vibrations (using for example accelerometers), rotary speed, weight on bit, rotary current, hoist current, noise or sound (using for example microphones) among other parameters. Drilling vibration, rotary motor current and/or sound are signals sensitive to bit wear and follow a trend as the bit becomes worn and gets close to the failure zone.

According to an embodiment, numerous accelerometers from among the sensors 11 are distributed on various locations of the rig and mast. For example, the sensors 11 may include a rig vertical accelerometer, a rig horizontal accelerometer, lower mast accelerometers X, Y and Z, and higher mast accelerometers X, Y and Z. Considering the harsh environment of a drilling rig, the accelerometers may be heavy-duty accelerometers with the appropriate measurement range. According to a further embodiment, the lower mast accelerometers X, Y and Z and higher mast accelerometers X, Y and Z were in the form of two heavy duty tri-axial accelerometers, e.g., one mounted on the base of the mast near the drill pipe bush and the other one was mounted at three quarters of the mast height. These are contemplated locations that produce useful vibration readings, yet other locations are possible as well.

Moreover, cables (such as long certified shielded cables) and mounts such as industrial magnetic mounting may be used, with the system 10 supplying enough excitation voltage for the accelerometers 11. Among other sensors, the sensors 11 may measure rotary motor voltage and current, hoist motor voltage and current, and bailing air pressure. A pipe head encoder may also be one of the sensors 11. In accordance with another embodiment, all sensors may be covered with a protective case (e.g., metal case) for impact protection.

The system 10 further includes a signal processing unit 12 to receive and interpret the signals from the sensors 11 (e.g., interpreting being a conversion of the signal in desired units). A condition monitoring module 13 receives the interpreted signals from the signal processing unit 12 and can monitor the condition of the bit. The condition monitoring module 13 may consequently output data, such as the condition of the bit, an alarm of imminent failure, an estimation of a remaining useful life for the bit, among other outputs. The condition monitoring module 13 identifies the signal features from the sensors 11 that are affected only by the bit wear and have a meaningful trend as the bit condition changes from a brand new bit to a totally worn out bit.

According to an embodiment, the condition monitoring module 13 may perform different actions though its monitoring of the drilling process. In an embodiment, the condition monitoring module 13 may provide an assessment of the bit condition for example in the form of a classification. One contemplated classification is shown at 14 in FIG. 1, and is defined as follows, compliant with bit behavior:

Class 1: New bit—All healthy bit

Class 2: Slight wear on the teeth on cone edges

Class 3: Bearing(s) beginning to get loose and signs of progressive teeth wear and missing teeth Class 4: Deterioration stage—loose bearings—Accelerated bearing/teeth wear Class 5: Failure stage—Excessive bearing looseness—Bit change is required to avoid bearing failure.

Generally, in tricone drilling, the primary failure mode is bearing failure and in case of other failure modes, the bit may end up with a bearing failure if the system 10 is not stopped at some point when using a worn bit. Over-usage of a bit may result in direct production losses including lower rate of penetration (ROP) and lower hole quality and precision, as well as long term costs for an operator because of imposing high amounts of vibrations and tensions to the rig and thereby increasing maintenance costs and down times. Furthermore, in the case of catastrophic failure during the operation, one or more cones of the bit may detach from the main body of the bit and remain in the bottom of the hole. A manual removal of the bit parts from the hole may be required to continue the operation, and avoid damaging a new bit drilling the same hole, as well as mineral processing equipment in the next stages of production.

In yet another embodiment, the condition monitoring module 13 may alert the user of an imminent catastrophic failure and even shut the drilling process down if the process signals indicate such imminence. The condition monitoring module 13 may therefore command a shutdown mode of the system 10, for safe replacement of the worn tricone bit C. For example, the condition monitoring module 13 may command the shutdown of the drilling operation, especially if the drilling rig is an automated drilling rig operated by an automated control system.

Vibration Analysis

Upon receiving interpreted vibration signals from the sensors 11, the condition monitoring module 13 may detect that the bit has become worn as some specific frequency bands change in amplitude only when the bit becomes worn. These changes happen as the bit wear progresses and the bit gets close to being totally worn or in the potential failure zone, regardless of changes in geology conditions.

Therefore, the condition monitoring module 13 may continuously analyze all drilling signals during the bit's life cycles. Vibration signals in lateral and longitudinal direction may be analyzed in time and frequency domains coming from all accelerometers among the sensors 11 and located in different spots to find the most informative signal features sensitive to bit wear. In accordance with an embodiment, as described below, the signal processing unit 12 may use Fast Fourier Transform (FFT) to transform the signals from the time domain. In the next phase, the condition monitoring module 13 may apply Wavelet Packet Decomposition (WPD) to focus on the desired frequency bands and also feature extraction.

The condition monitoring module 13 may calculate a natural frequency of the drill pipe(s) B. Every bearing based on its design and geometry and speed of operation has its own fundamental frequencies. These frequencies are excited when an anomaly is created in the contact surface of the inner race, outer race or the roller itself. A drill string including the drill pipe(s) B a tricone bit 3D virtual model may be created/obtained for subsequent use by the condition monitoring module 13 for modal analysis. In order to confirm the numerical model results, fundamental frequencies of the drill string, assuming different lengths and boundary conditions were calculated using the equation (1) provided below [J. C. Wachel, et al. 1990]. The first and second frequency modes of axial vibration in three types of boundary conditions for the string consisting of one and two pipes are reported in tables 1 and 2.

$$f_n = \frac{\lambda}{2\pi} \cdot \sqrt{\frac{gEI}{\mu L^4}} \tag{1}$$

In which $f_n$=Vibration frequency mode, Hz g=Gravity, 9.8 m/s$^2$

E=Modulus of elasticity, Pa

I=Polar moment of inertia, m$^4$

L=Length, m

λ=Frequency factor, dimensionless

μ=Weight per unit length, kg/m

TABLE 1

First and second fundamental frequency for string with one pipe

| Boundary condition | 1$^{st}$ mode (Hz) | 2$^{nd}$ mode (Hz) |
|---|---|---|
| Fixed top - Fixed bit | 104.09 | 286.72 |
| Fixed top - Supported bit | 71.56 | 232.35 |
| Fixed top - Free bit | 16.36 | 104.09 |

TABLE 2

First and second fundamental frequency for string with two pipes

| Boundary condition | 1$^{st}$ mode (Hz) | 2$^{nd}$ mode (Hz) |
|---|---|---|
| Fixed top - Fixed bit | 29.57 | 81.44 |
| Fixed top - Supported bit | 20.33 | 66 |
| Fixed top - Free bit | 4.65 | 29.57 |

As per equation 1, the drill string length is a significant parameter in changing the fundamental frequencies. For a drilling depth of around 15 meters, two drill pipes are required. Assuming the wide rotary speed range in blasthole drilling from 50 rpm to 150 rpm which is equal to 0.833 Hz to 2.5 Hz, the axial vibration fundamental frequencies of drill string in all the three boundary conditions are well above the pipe rotational frequency. Accordingly, as the pipe rotational speed and fault frequencies do not overlap the natural frequencies, a frequency analysis is not exposed to a resonance phenomenon.

The condition monitoring module 13 may monitor the frequency spectrum throughout the drilling process. As mentioned above, the signal processing unit 12 may transfer the drilling vibration signals from time to frequency domain using the Fast Fourier Transform (FFT), for the monitoring of the frequency spectrum by the condition monitoring module 13. By using the signals transferred to the frequency spectrum by the signal processing unit 12, the condition monitoring module 13 may detect specific frequency bands that change in amplitude when the bit becomes worn. These changes happen as the bit wear progresses and the bit gets close to being in a totally worn condition or potential catastrophic failure zone regardless of changes in geology and working conditions (e.g., a geology index). Vibration signals in lateral and axial directions obtained from the sensors 11 may consequently be monitored by the condition monitoring module 13 in the frequency domain to find the signal features and frequency bands sensitive to bit wear.

For example, tooth wear, which may be in the form of geometrical changes on the teeth or of tooth breakage, may cause a non-uniform distribution of cutting forces exerted on each cone of the tricone bit C. This phenomenon acts as an unbalance factor in rotation and excites the 1× rpm in the axial vibration frequency spectrum. Therefore, the monitoring of the wear progress by the condition monitoring module 13 may involve seeking an increase of this frequency component. However, any non-uniform contact force distribution from the geology and non-uniform geological condition may affect this reading, whereby it may be combined to other frequency readings for objective assessment. Stated differently, a geology index is taken into consideration during the monitoring of the bit condition due to the impact of the geological conditions on the vibrations on the drill string.

In accordance with another embodiment, the 3×rpm frequency peak at axial vibration is found to be the formation drillability indicator, i.e., the geology index indicative of the rock condition (e.g., hardness). In the similar bit wear condition, a decrease in the rate of penetration (ROP) may be caused by hitting harder rocks in constant WOB and rpm. Drilling in harder formations may consequently increase the 3×rpm peak in axial vibration spectrum. This monitoring of a lower frequency range for the vibration values by the condition monitoring module 13 may be used to properly identify threshold(s) for fault frequencies when the condition monitoring module 13 monitors the vibration signals.

Figure 2A:
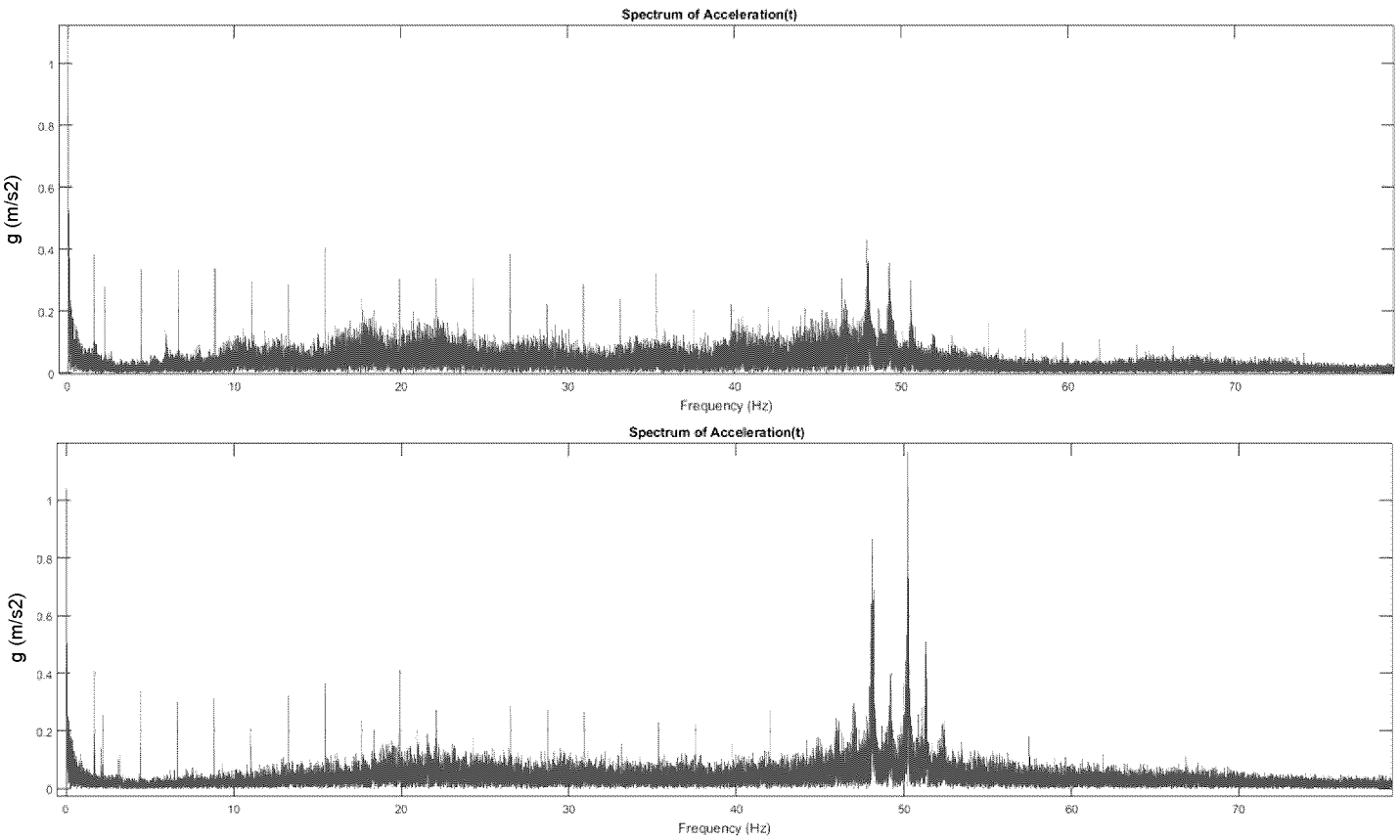
FIG. 2A are exemplary graphs showing vibrations as a function of frequency for a bit with worn bearings (top) and at a later stage of wear (bottom), with a failure imminent.

A series of harmonics of cone rotational speed (CRS) may be present and monitored by the condition monitoring module 13 in axial vibration frequency generated by the bit as it becomes worn. In particular conditions, these peaks start from 2×CRS and are detectable up to around 70 Hz. In addition, the frequency band around between 40 to 60 Hz is excited by bearing looseness and progressive teeth wear, such as in Class 3 above. This frequency range follows an incremental trend as the bit reaches the wear state of Class 4 described above, the frequency range significantly raising when the bit wears toward the state described in Class 5. A significant increase may be detected by the condition monitoring module 13 before the bit failure compared to the initial values. As an example, FIG. 2A shows vibration signals from the sensors 11 as a function of frequency, with an increase of up to 300% percent before failure.

Figure 2B:
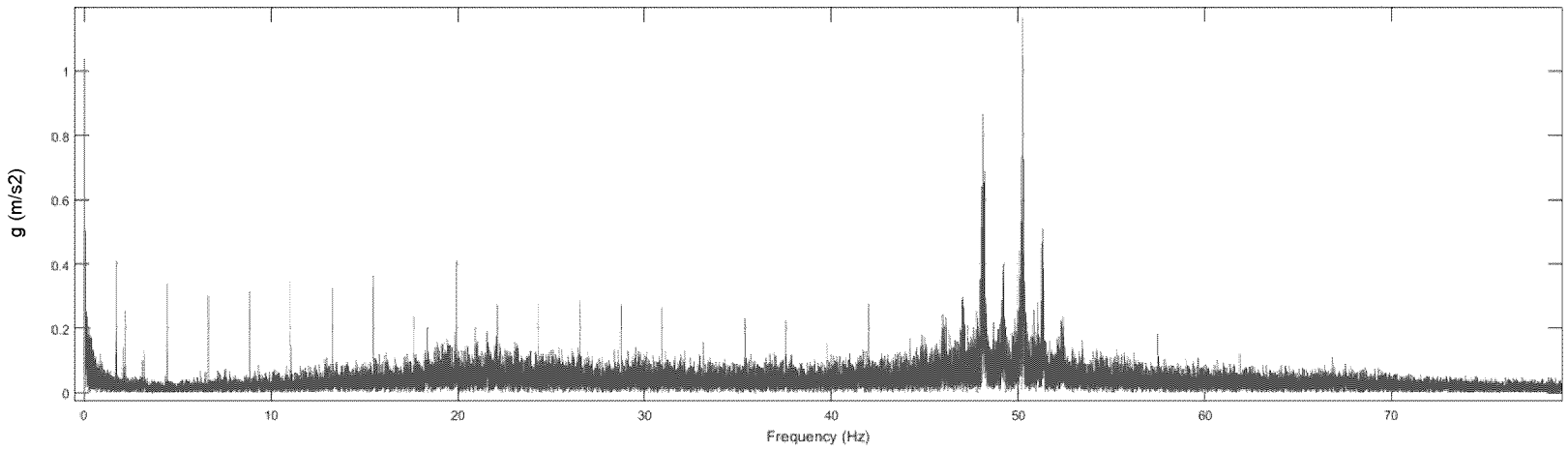
FIG. 2B is an exemplary graph of a Class 5 bit vibration frequency spectrum at 60 rpm.

The condition monitoring module 13 may also monitor the bit vibration frequencies. In the tricone bit C, a connection between cones and lugs consist of bearings, with an inner bearing (e.g., roller bearing), a middle bearing (e.g., a ball bearing), and an outer bearing (e.g. roller bearing). Every bearing of the tricone bit C has its own fundamental frequencies based on its design, geometry and speed of operation. These frequencies are excited when an anomaly is created in the contact surface of the inner race, outer race or the roller itself. During the drilling operation, as the bit C reaches a wear of the type of Class 3 above, with some looseness appearing, the cones and lugs edges are damaged. In such a case, the outer raceway of the outer roller bearings on each cone is prone to failure preliminarily. Field data analysis shows 5× harmonic of the ball pass frequency of inner bearing (BPFI) of an outer roller bearing in the tricone bit C is excited and sensible on the drillmast when the bit is worn to Class 3. As the operation continues, the looseness and higher clearance in the bearings may result in dust and minute rock chips penetrating the bearing area, even if the tricone bit C is equipped with sealed bearings. As the wear reaches to middle bearing in a class 4 type wear, the 5×harmonic of BPFI of middle bearing is excited as well, as in FIG. 2B. Excessive wear on middle bearing with lead to a Class 5 type wear, which may then lead to failure of middle bearing, with potential detachment of the cone and bit in catastrophic failure. Following formulations are suggested to calculate tricone bit failure frequencies:

$$ORB = \frac{NR}{24} \times \text{rpm} \times CRSR \times \left(1 - \frac{R}{PRB} \times \cos\theta\right) \tag{2}$$

$$MBB = \frac{NB}{24} \times \text{rpm} \times CRSR \times \left(1 - \frac{B}{PBB} \times \cos\theta\right) \tag{3}$$

Figure 3:
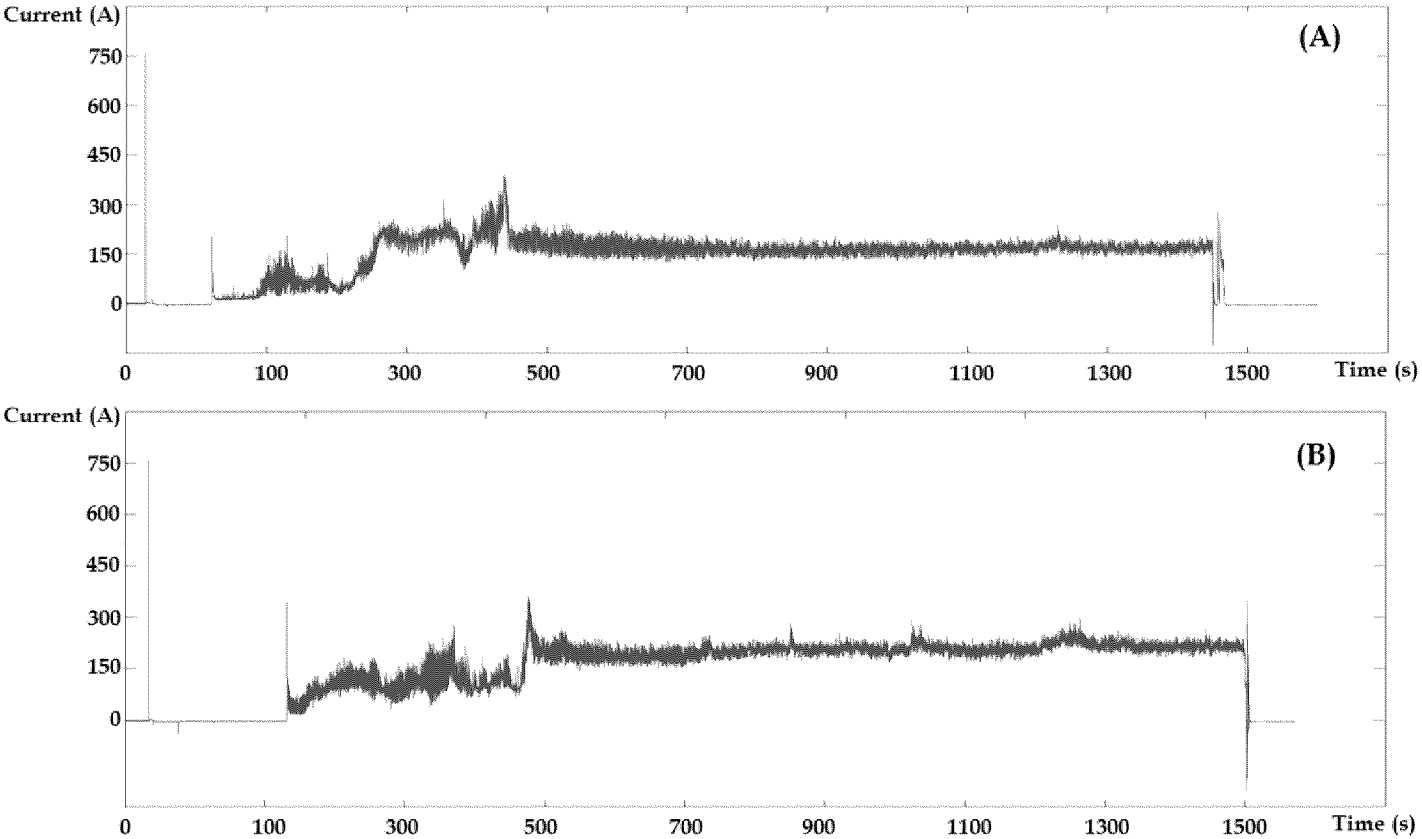
FIG. 3 is an exemplary graph of a time domain rotary motor current signal, with a new bit (A) and a 70% used bit (B)

Where:

ORB=Outer roller bearing failure frequency in Hz
MBB=Middle ball bearing failure frequency in Hz
NB=Number of balls
NR=Number of rollers
rpm=Revolution per minute of the bit
CRSR=Cone rotational speed ratio to the bit rpm
B=Ball diameter (mm)
R=Roller diameter (mm)
PBB=Ball bearing pitch diameter (mm)
RBB=Roller bearing pitch diameter (mm)
θ=Bearing contact angle In equations 2 and 3, bit design parameters have a minor effect of the fault frequencies. As discussed above, depending of the bit geometrical design, the CRSR ranges between 1.25 to 1.31 of the bit rotary speed which is equivalent to a potential growth in the readings (e.g., 5%). An influential parameter in changing bit fault frequencies is bit rotary speed (rpm). A rotary speed range in blasthole drilling is typically 60-90 rpm in practice. Assuming the contact angle in a range of 5 to 45 degrees and applying the CRSR range, the tricone failure frequencies will be in a range between 45 Hz and 78 Hz. The developed approach however, by application of wavelet packets, covers any possible range of failure frequencies and the sidebands generated by the tricone bits. Accordingly, the condition monitoring module 13 may calculate the failure frequencies using equations 2 and 3 provided above. The condition monitoring module 13 may also monitor the condition of the bit using a rotary motor current analysis. This may for instance be used to confirm the assessment of the bit condition using the vibration values. Referring to FIG. 3, the rotary motor current analysis shows that this signal is sensitive to bit wear and can be used for wear monitoring purposes by the condition monitoring module 13. As the bit becomes worn, the current signal starts to scatter and fluctuate as shown by the graph.

Figures 4, 5:
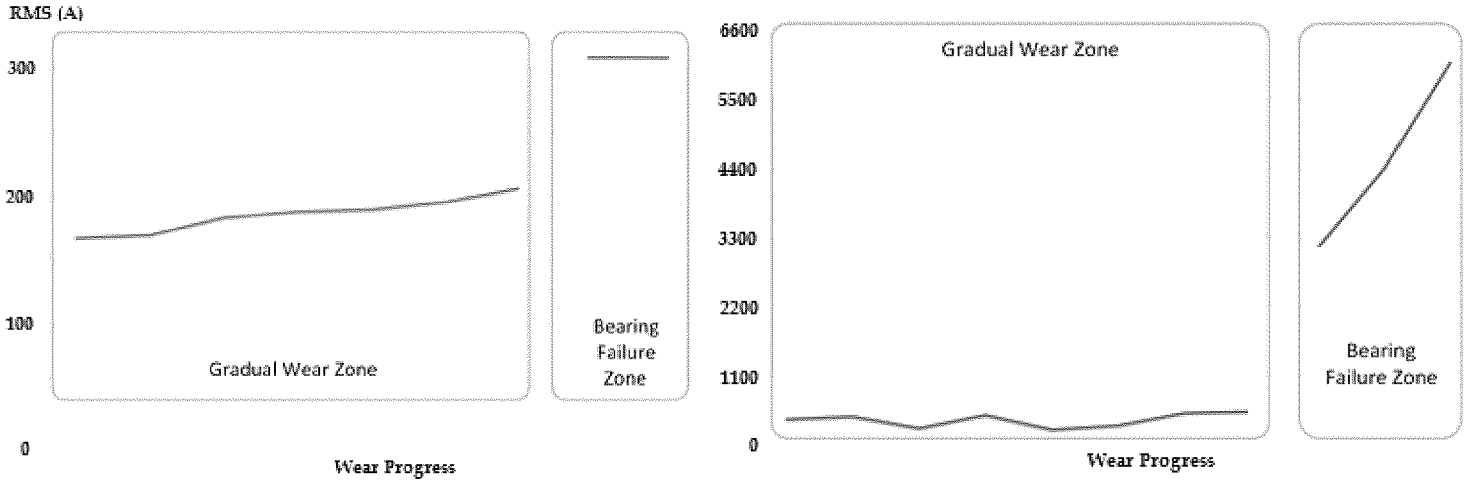
FIG. 4 is an exemplary graph of a RMS trend of a rotary motor current vs. wear progress.
FIG. 5 is a graph of a variance trend of a rotary motor current vs. wear progress.

As another monitoring parameter, the condition monitoring module 13 may monitor a similar scattering phenomenon in bearing wear at a higher intensity, with statistical features include root mean square, standard deviation, skewness, and/or kurtosis. FIGS. 4 and 5 show the trends of RMS and variance of current signal in different stages of bit wear. As shown in FIG. 4, the RMS value of rotary motor current has an incremental trend that can be monitored by the condition monitoring module 13 as bit teeth wear increases. In the bearing failure zone, a significant jump in RMS may be detected and can be monitored by the condition monitoring module 13, since the worn bearings require more torque to continue the rotation at a stationary rotational speed. The electric motor will draw more current to provide the required torque ($\tau \propto I$) where $\tau$—Torque is measured in Newton meters (N.m) and I—Current is measured in amperes (A).

As illustrated in FIG. 5, the rotary motor current variance is an indicator of bearing wear that may be monitored by the condition monitoring module 13. Progress of bearing wear in the tricone bit results in an incremental trend in the signal variance. In a contemplated embodiment, the monitoring of a lower frequency range for the vibration values to assess a geology index, and of a higher frequency range to identify a fault frequency relative to a threshold based on the geology index, is does by wavelet decomposition by the condition monitoring module 13. The system 10 extracts the signal features from the wavelet packets corresponding to the fault frequencies and feed them to a classifier module 14 (e.g., for instance having a neural network).

Figure 6:
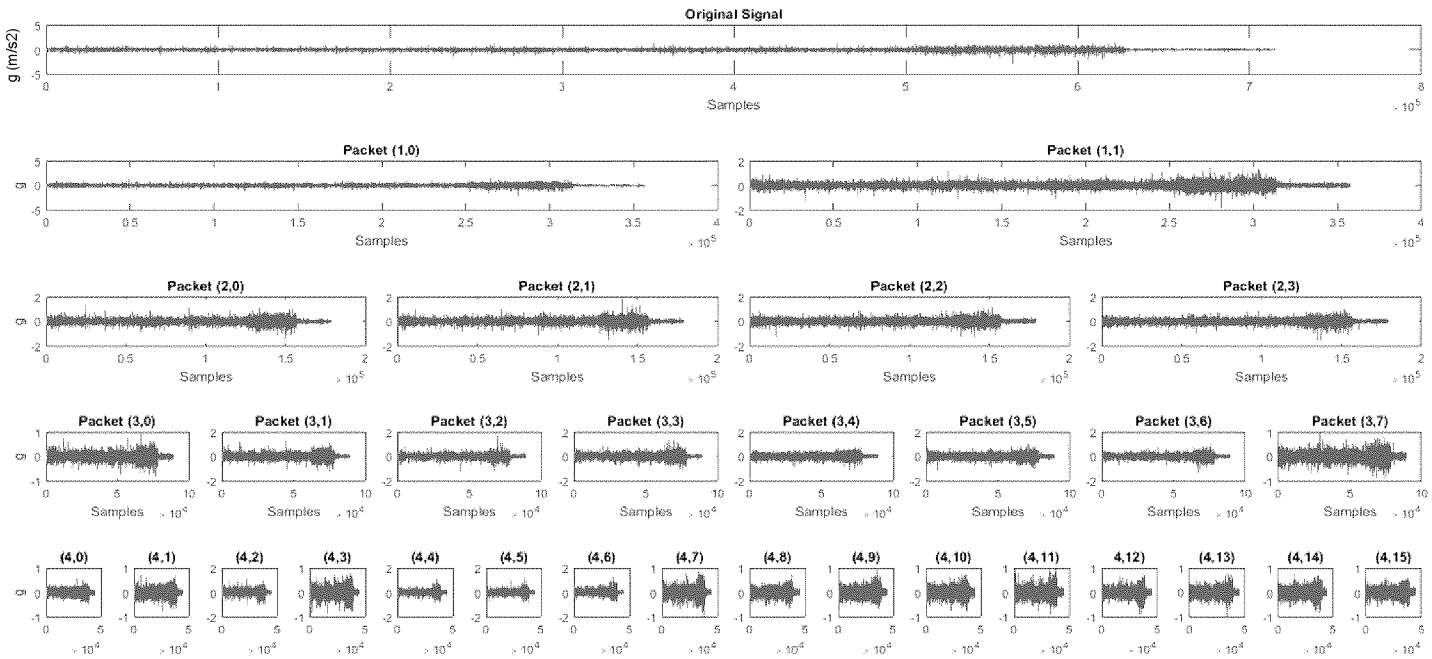
FIG. 6 is an exemplary graph of four-level wavelet decomposition.

As illustrated by FIG. 6, the condition monitoring module 13 may operate a wavelet packet method in the form of a generalization of wavelet decomposition that provides a wider range of possibilities for signal analysis. In wavelet analysis, a signal is split into an approximation and a detail. Then, the approximation itself is divided into another level approximation and detail, and the process is repeated. For n-level decomposition, there are n+1 possible ways to decompose the signal, but in wavelet packet analysis, the details, as well as the approximations, can be split. This results in 2n ways to decompose the signal. By this means signal statistical features are specifically extracted from the wavelet packet that is affected by the bit wear and includes bit failure frequencies.

The condition monitoring module 13 may include the classifier module 14 with neural network. Signal statistical features extracted from the vibration wavelet packets as well as motors electrical signals and control signals provide the inputs to the classifier module. A feedforward backpropagation neural network with one hidden layer may be trained based on field data to perform the classification. The neural network model classifies the bit health condition into the five introduced Classes of bit wear state.

Consequently, the fault frequencies are exited only by worn tricone bits C and they grow in amplitude by the excessive wear. The bit state classification is done by the power of neural networks according to the frequency analysis and extraction of features from wavelet packet decomposition.

The signal features extracted from the sensors 11 and processed by the signal processing unit 12 may be used by the condition monitoring module 13 to classify the bit condition into different wear categories, such as Classes 1-5 defined above. As another example, the signal features may be interpreted by the condition monitoring module 13 to indicate that the bit is any one of a sharp bit, a workable bit, and a worn bit. The system 10 and related method therefore perform indirect bit wear monitoring based on real-world full scale vibration and electric current signals, and operate without interruption of the drilling operation. The condition monitoring module 13 can predict failure regardless of rock material, or like geology index, as the condition monitoring module 13 monitors lower frequency vibrations to take into consideration rock hardness to properly monitor the fault frequencies. The method is for monitoring a bit condition in a drilling operation, by: obtaining signals representative of at least vibrations of a drilling mast having at least one bit during a drilling operation; interpreting the signals into vibration values; continuously monitoring the vibration values in real time; and assessing and outputting a condition of the bit as a function of the continuous monitoring of the vibration values. In an embodiment, the Class-5 bit condition is the bit just before failure, so the system 10 is able to anticipate the failure of tricone bits C.

The invention claimed is:

1. A system for monitoring a bit condition in a drilling operation, the system comprising:

a processor unit; and a non-transitory computer-readable memory communicatively coupled to the processing unit and comprising computer-readable program instructions executable by the processing unit for:

obtaining signals obtained from sensors directly on a drilling mast, the signals representative of at least vibrations of the drilling mast having at least one bit during a drilling operation;

interpreting the signals into vibration values;

continuously monitoring the vibration values and a current of a motor of the drilling mast in real time; and assessing and outputting a condition of the bit as a function of the continuous monitoring of the vibration values, the assessing including confirming the bit condition using the current of the motor.

2. The system according to claim 1, wherein continuously monitoring the vibration values includes:

monitoring a lower frequency range of the vibration values to determine a geology index, and monitoring a higher frequency range of the vibration values to identify a fault frequency relative to a threshold based on the geology index.

3. The system according to claim 2, wherein monitoring the lower frequency range and the higher frequency range includes performing a wavelet decomposition of the vibration signals.

4. The system according to claim 2, wherein assessing the bit condition includes classifying the bit condition as a function of the fault frequency and of the geology index.

5. The system according to claim 4, wherein classifying the bit condition includes outputting a class for the bit condition.

6. The system according to claim 5, wherein outputting a class includes outputting the class from among a group of classes including:

Class 1, new bit;

Class 2, slight wear on teeth of cone edges;

Class 3, at least one bearing with looseness, progressive teeth wear and/or missing teeth;

Class 4, deterioration stage with loose bearing and accelerated bearing and/or teeth wear; and Class 5, excessive bearing looseness and bit change required to avoid bearing failure.

7. The system according to claim 1, wherein assessing and outputting a condition of the bit includes commanding a stop of drilling.

8. The system according to claim 1, wherein interpreting the signals into vibration values includes converting the vibrations values from a time domain to a frequency domain.

9. An automated drilling rig comprising:

at least one drilling mast having at least one drilling bit, the drilling mast operated in a drilling process;

sensors directly on the drilling mast to monitor vibrations of the at least one drilling mast;

an automated control system for operating the at least one drilling mast in the drilling process; and the system according to claim 1 to monitor the bit condition of the at least one drilling bit.

10. The automated drilling rig according to claim 9, wherein the at least one drilling bit is a tricone bit.

11. The automated drilling rig according to claim 9, wherein the sensors include accelerometers.

12. A system for monitoring a bit condition in a drilling operation, comprising:

sensors adapted to be positioned directly on a drilling mast having at least one bit to produce signals representative of at least vibrations during a drilling operation;

a signal processing unit for interpreting the signals into vibration values; and a condition monitoring module for monitoring the vibration values and a current of a motor of the drilling mast in real time, for assessing and outputting a condition of the bit, and for confirming the bit condition using the current of the motor.

13. The system according to claim 12, wherein the condition monitoring module monitors the vibration values by:

monitoring a lower frequency range of the vibration values to determine a geology index, and monitoring a higher frequency range of the vibration values to identify a fault frequency relative to a threshold based on the geology index.

14. The system according to claim 13, wherein the condition monitoring module monitors the lower frequency range and the higher frequency range by performing a wavelet decomposition of the vibration signals.

15. The system according to claim 13, wherein the condition monitoring module assesses the bit condition by classifying the bit condition as a function of the fault frequency and of the geology index.

16. The system according to claim 15, wherein the condition monitoring module classifies the bit condition by outputting a class for the bit condition.

17. The system according to claim 12, wherein the condition monitoring module commands a stop of drilling as a function of the bit condition.

18. The system according to claim 12, wherein the signal processing unit interprets the signals into vibration values by converting the vibrations values from a time domain to a frequency domain.

* * * * *